US012383812B2

(12) United States Patent
Beier

(10) Patent No.: US 12,383,812 B2
(45) Date of Patent: Aug. 12, 2025

(54) BALL GLOVE WITH BACKFINGER LACE

(71) Applicant: RAWLINGS SPORTING GOODS COMPANY, INC., St. Louis, MO (US)

(72) Inventor: Joshua Arden Beier, St. Louis, MO (US)

(73) Assignee: RAWLINGS SPORTING GOODS COMPANY, INC., St. Louis, MO (US)

( * ) Notice: Subject to any disclaimer, the term of this patent is extended or adjusted under 35 U.S.C. 154(b) by 0 days.

(21) Appl. No.: 18/395,103

(22) Filed: Dec. 22, 2023

(65) Prior Publication Data

US 2025/0205583 A1 Jun. 26, 2025

(51) Int. Cl.
*A63B 71/14* (2006.01)
*A63B 102/18* (2015.01)

(52) U.S. Cl.
CPC ..... *A63B 71/143* (2013.01); *A63B 2102/18* (2015.10); *A63B 2102/182* (2015.10)

(58) Field of Classification Search
CPC ..... A63B 71/143; A63B 2102/18; A63B 2102/182
See application file for complete search history.

(56) References Cited

U.S. PATENT DOCUMENTS 1,631,735 A * 6/1927 Kennedy ..... A63B 71/143 D29/115
1,826,851 A * 10/1931 Whitley ..... A63B 71/143 2/19
3,098,234 A * 7/1963 Latina ..... A63B 71/143 2/19
3,169,250 A * 2/1965 Heiman ..... A63B 71/143 D29/115
6,353,931 B1 * 3/2002 Gilligan ..... A63B 71/143 2/19
7,013,486 B1 * 3/2006 Sullivano ..... A63B 71/143 2/19
2011/0016596 A1 * 1/2011 Rhoades ..... A63B 71/143 2/19
2012/0079641 A1 * 4/2012 Kirchner ..... A41D 19/002 2/19
2020/0268076 A1 * 8/2020 Newman ..... A63B 71/143
2023/0136834 A1 * 5/2023 Yamada ..... A63B 71/143 2/19

OTHER PUBLICATIONS

Rawlings, "2022 Limited Edition REV1X 11.75-Inch Infield Glove", Url: https://web.archive.org/web/20220519172855/https:/www.rawlings.com/product/RSGREVFL12-32.html, webpage archive dated May 19, 2022; webpage visited Dec. 22, 2023.

* cited by examiner

*Primary Examiner* — Tajash D Patel
(74) *Attorney, Agent, or Firm* — Perkins Coie LLP

(57) ABSTRACT

Representative embodiments of the present technology include a ball glove having a plurality of finger stalls and a thumb stall, in which connecting lacing for at least some of the finger stalls is only between the finger stalls or on a back side of the finger stalls, such that the ball glove has limited (or no) lacing projecting into the catching area (the front/palm side of the glove) that can snag a player's hand or other object during play.

23 Claims, 6 Drawing Sheets

BALL GLOVE WITH BACKFINGER LACE

BACKGROUND

Conventional ball gloves include lacing connecting the finger stalls that is positioned on the front face of the glove and that projects into the catching area. Conventional ball gloves may also include palm lacing in the palm portion of the glove that projects into the catching area. After catching a ball with a glove, a player often quickly reaches into the glove to retrieve the ball. The player's hand may snag on the lacing, or the ball may engage the lacing, due at least in part to its projection into the catching area, slowing or hampering the player's retrieval of the ball from the glove. Embodiments of the present technology are addressed to resolving these problems and other problems with conventional ball gloves.

SUMMARY

Representative embodiments of the present technology include a ball glove having a plurality of finger stalls and a thumb stall, in which connecting lacing for at least some of the finger stalls is only between the finger stalls or on a back side of the finger stalls, such that the ball glove has limited (or no) lacing projecting into the catching area (the front/palm side of the glove) that can snag a player's hand or other object during play.

Other features and advantages will appear hereinafter. The features described herein can be used separately or together, or in various combinations of one or more of them.

BRIEF DESCRIPTION OF THE DRAWINGS

In the drawings, wherein the same reference number indicates the same element throughout the views.

DETAILED DESCRIPTION

The present technology is directed to ball gloves with backfinger lacing, and associated systems and methods. Various embodiments of the technology will now be described. The following description provides specific details for a thorough understanding and enabling description of these embodiments. One skilled in the art will understand, however, that the invention may be practiced without many of these details. Additionally, some well-known structures or functions, such as those common to ball gloves (such as baseball or softball gloves), may not be shown or described in detail to avoid unnecessarily obscuring the relevant description of the various embodiments. Accordingly, embodiments of the present technology may include additional elements or exclude some of the elements described below with reference to FIGS. 1-6, which illustrate examples of the technology.

The terminology used in this description is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list. Further, unless otherwise specified, terms such as "attached" or "connected" are intended to include integral connections, as well as connections between physically separate components.

Figure 1:
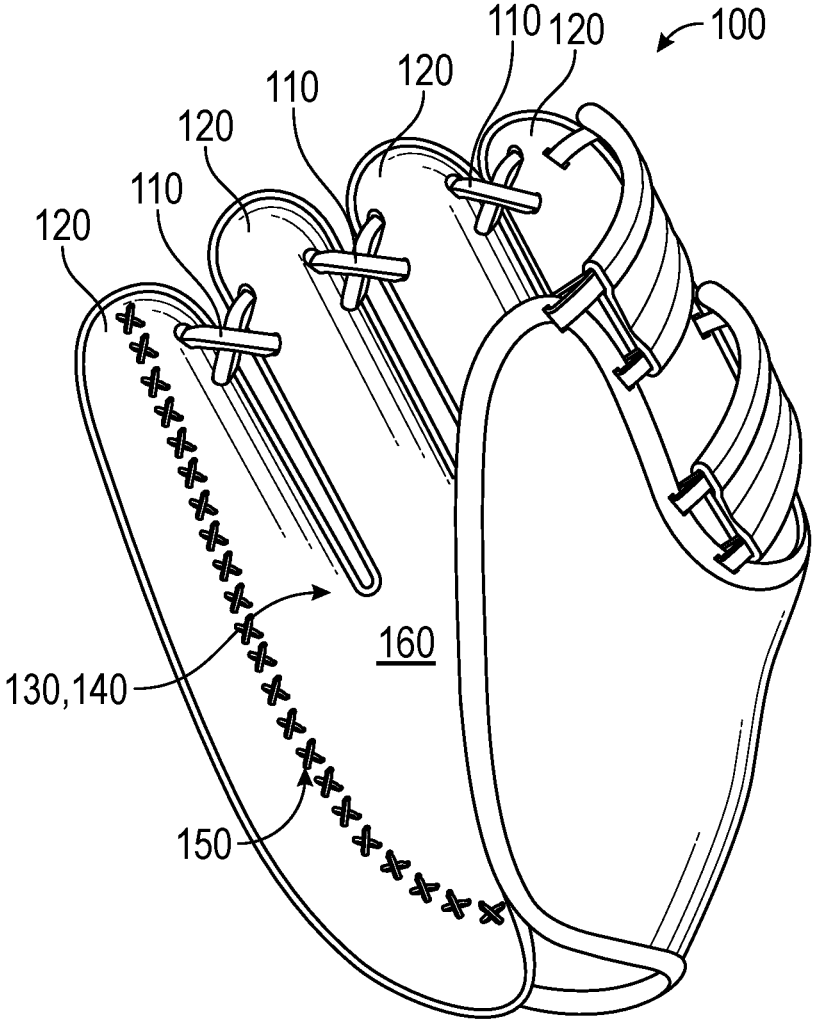
FIG. 1 (Prior Art)
FIG. 1 illustrates a perspective view of a prior art ball glove.

For purposes of the present disclosure, a first element that is positioned "toward" an end of a second element is positioned closer to that end of the second element than to a middle or mid-length location of the second element. Numerical adjectives including "first" and "second," or the like, as used in the present disclosure, do not convey hierarchy or specific features or functions. Rather, such numerical adjectives are intended to aid the reader in distinguishing between elements which may have similar nomenclature, but which may differ in position, orientation, or structure. Accordingly, such numerical adjectives may be used differently in the claims FIG. 1 illustrates a perspective view of a prior art ball glove 100. Conventional ball gloves include lacing 110 connecting the finger stalls 120 that is positioned on the front face 130 of the glove 100 and projects into the catching area 140. Conventional ball gloves may also include palm lacing 150 in the palm portion 160 of the glove 100 that also projects into the catching area 140. After catching a ball with the glove 100, a player typically reaches quickly into the glove 100 to retrieve the ball. The player's hand may snag on the lacing 110, 150, or the ball may engage the lacing 110, 150, due at least in part to its projection into the catching area 140. Embodiments of the present technology resolve this and other problems with prior art gloves.

Figure 2:
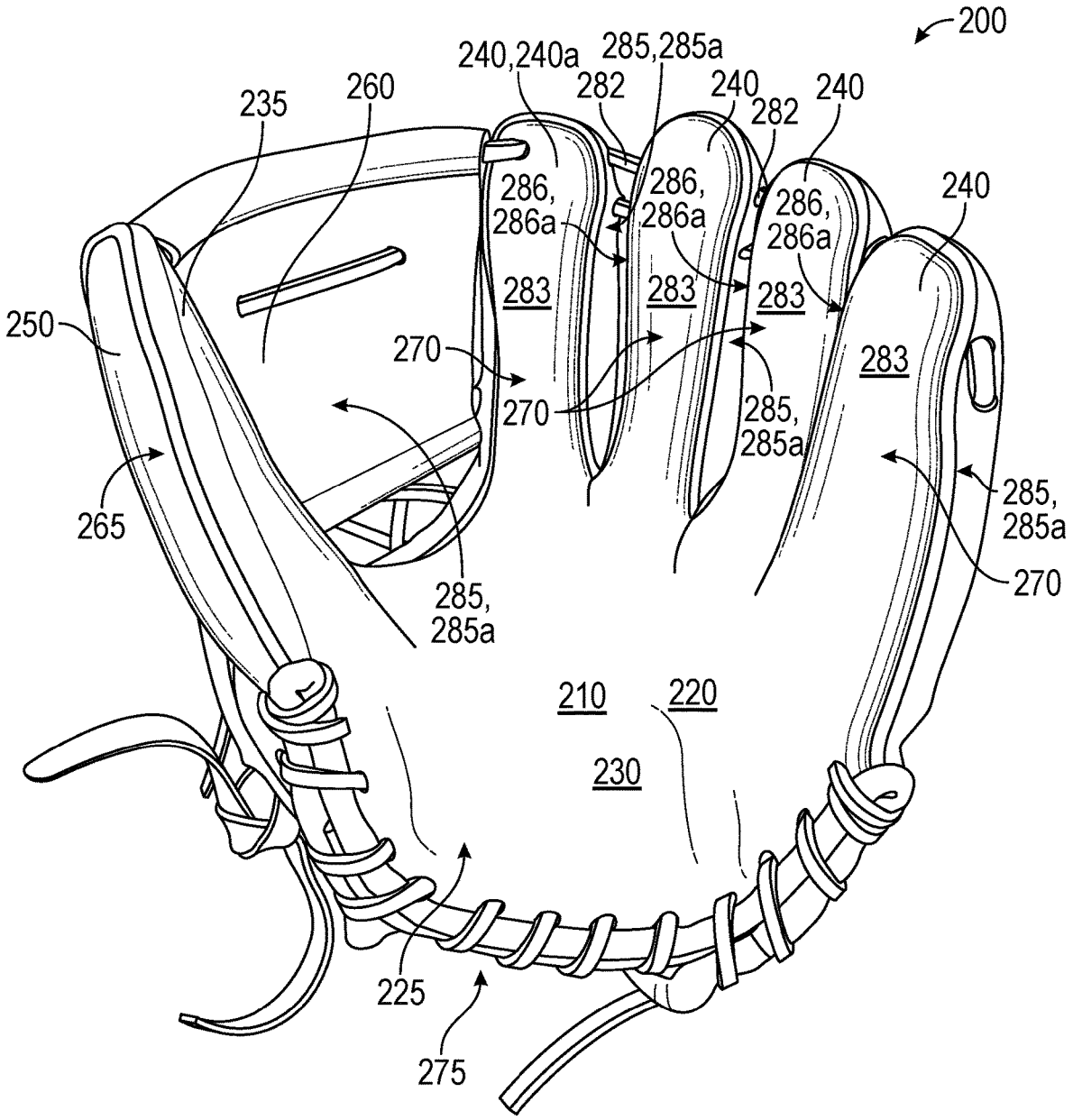
FIG. 2 illustrates a front view of a ball glove configured in accordance with embodiments of the present technology.
Figure 3:
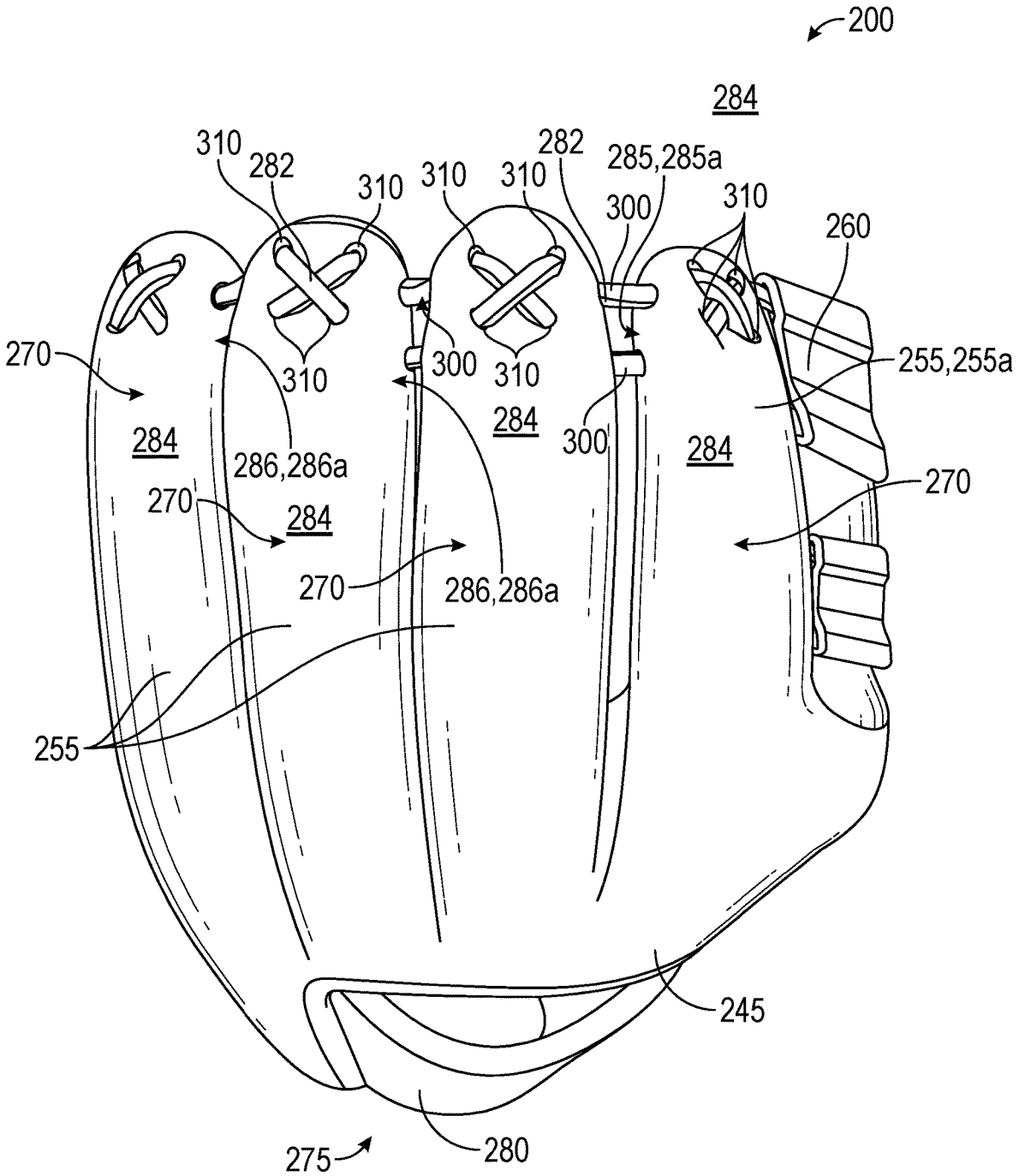
FIG. 3 illustrates a rear view of the ball glove shown in FIG. 2.

For example, FIG. 2 illustrates a front view of a ball glove 200 configured in accordance with embodiments of the present technology. FIG. 3 illustrates a rear view of the ball glove 200 shown in FIG. 2. With reference to FIG. 2, little or no lacing may reside on a front side 210 (which includes a catching area 220) of the glove 200, which is accomplished at least in part by lacing glove finger stalls in accordance with the present technology. The ball glove 200 provides a smoother or cleaner front side 210 and catching area 220 with reduced (e.g., minimal, or without any) lacing for a user to snag when retrieving a ball from the glove 200.

With reference to FIGS. 2 and 3, in some embodiments, the ball glove 200 may include a front portion 225 including a palm section 230, a first thumb section 235, and a plurality of front finger sections 240 (e.g., four front finger sections 240, although there may be fewer finger sections if a section accommodates multiple fingers). The ball glove 200 may further include a back portion 245 including a second thumb section 250 and a plurality of back finger sections 255 (e.g., four back finger sections 255, although there may be fewer finger sections if a section accommodates multiple fingers). The ball glove 200 may further include a web portion 260 connecting one or both of the first thumb section 235 and the second thumb section 250 to a first front finger section 240*a* of the plurality of front finger sections 240 or to a first back finger section 255*a* of the plurality of back finger sections 255.

The front portion 225 may be connected to the back portion 245 using any suitable fastening systems or devices, such as stitching, riveting, or gluing, or the front portion 225 and the back portion 245 may be connected by being integral with one another. The first thumb section 235 of the front portion 225 may be connected to the second thumb section 250 to form a thumb stall 265 for receiving a user's thumb inside the glove 200 using any of the foregoing suitable fastening systems or devices, or they may be connected by being integral with one another. Each front finger section 240 of the plurality of front finger sections 240 may be connected to a corresponding back finger section 255 of the plurality of back finger sections 255 to form a plurality of finger stalls 270 (e.g., four finger stalls 270) for receiving a user's fingers inside the glove 200.

The ball glove 200 includes an opening 275 between the front portion 225 and the back portion 245 to receive a user's hand. The opening 275 may be adjustable with a wrist strap 280 or another suitable adjustment device. Each finger stall 270 of the plurality of finger stalls 270 may be connected to an adjacent finger stall of the plurality of finger stalls via lacing 282 positioned generally toward a distal end of the glove away from the opening 275. In some embodiments, the lacing 282 may include one continuous strand, multiple strands linked together, or multiple individual strands, each individual strand linking at least two finger stalls 270 together.

In some embodiments, for some or all (e.g., at least two, or at least three, or all four or more) of the finger stalls 270, the lacing 282 does not pass through a front surface 283 of the finger stalls 270 (e.g., the lacing 282 does not pass through the surface of the front portion 225 facing the catching area 220, which is opposite the back surface 284). Such an embodiment is shown generally in FIG. 2, for example.

Each finger stall 270 may have two opposing side portions 285, 286 adjacent to the front and back sections 240, 255 or front and back surfaces 283, 284. The opposing side portions 285, 286 may connect the front sections 240 to the back sections 255. In some embodiments, one or more of the side portions 285, 286 may be part of the front or back sections 240, 255. Each finger stall 270 may have opposing side surfaces 285*a*, 286*a* on the corresponding side portions 285, 286, between and adjacent to the front and back surfaces 283, 284.

In some embodiments, for some or all of the finger stalls 270, the lacing 282 may pass or extend through and between the two opposing side portions 285, 286 and the opposing side surfaces 285*a*, 286*a*. With specific reference to FIG. 3, In some embodiments, the lacing 282 passing through and between the two opposing side portions 285, 286 forms two or more lacing lines 300 that do not intersect with each other (e.g., they may be parallel or approximately parallel). In some embodiments, the lacing 282 may cross over itself at the back surface 284 of one or more (such as two or more, three or more, or each) finger stalls 270 (e.g., the lacing 282 may pass through a plurality of openings 310, such as four openings 310, on the back surface 284).

With reference to FIG. 2, various embodiments of the present technology (including those disclosed below) may additionally or alternatively omit lacing from the palm section 230 for an even smoother glove catching area or pocket. In general, the lacing 282 is positioned behind the front of the glove, weaving in and out of the back surfaces 284 and between the finger stalls 270, rather than passing through the front surfaces 283, for some or all of the finger stalls 270.

Figure 4:
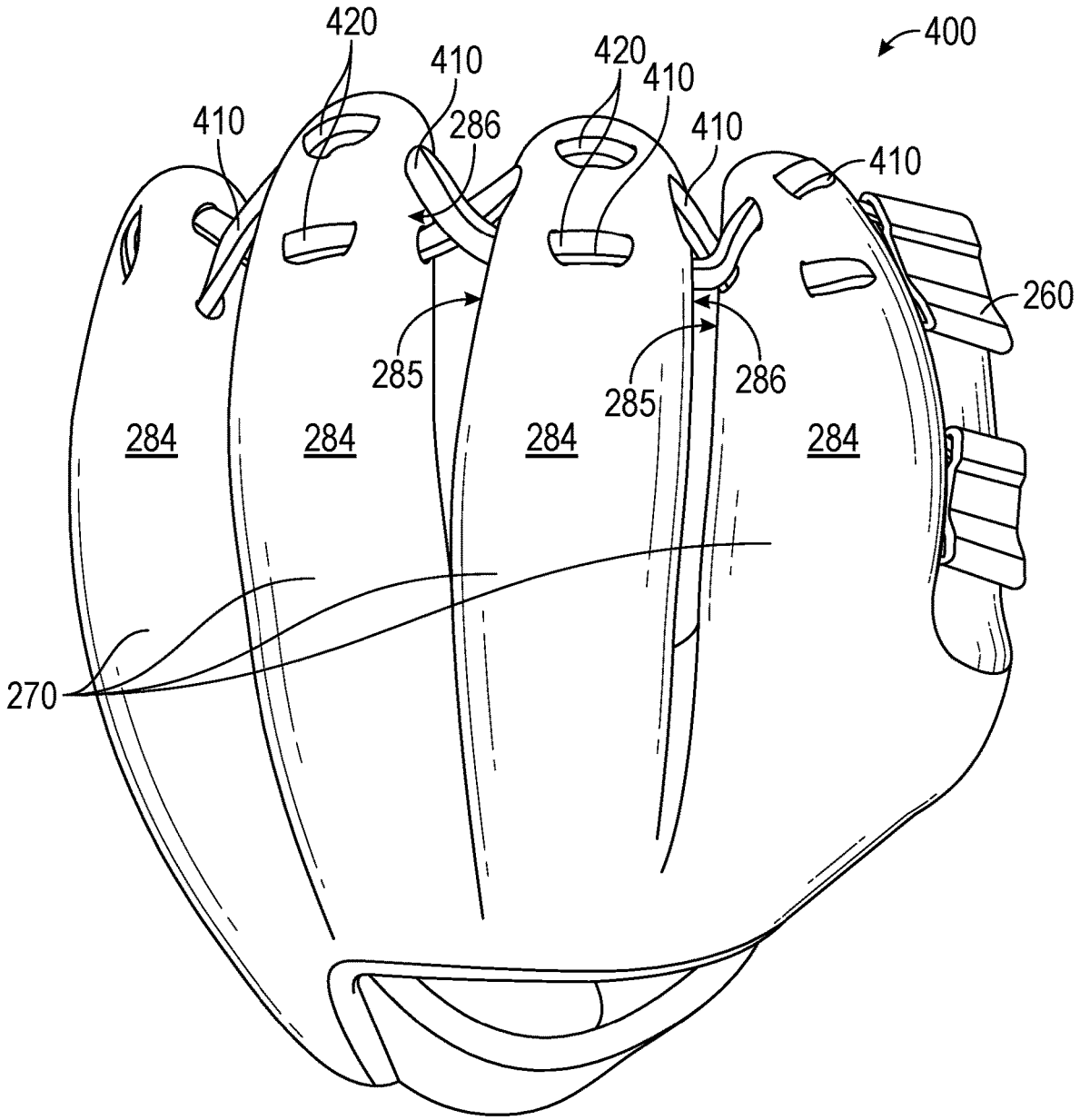
FIG. 4 illustrates a rear view of a ball glove configured in accordance with further embodiments of the present technology.

FIG. 4 illustrates a rear perspective view of a ball glove 400 configured in accordance with further embodiments of the present technology. Like the glove 200 described above with regard to FIGS. 2 and 3, the glove shown in FIG. 4 may not have lacing that passes along the front surface of one or more (such as all) of the finger stalls 270. Accordingly, the front side of the glove 400 is not shown, and the front side may have the same general configuration as the front side shown in the front view of the glove 200 in FIG. 2. Lacing 410 may weave or extend through and between the opposing side portions 285, 286 and the back surfaces 284 of the finger stalls 270.

In some embodiments, the lacing 410 that extends between the two opposing side portions 285, 286 crosses over itself between at least two (e.g., at least three or four) of the finger stalls 270 (i.e., forming an "x" pattern like in FIG. 4). The location where the lacing 410 crosses over itself is also between the front and back surfaces 283, 284. Accordingly, for most of the glove 400, there is no lacing the player can snag on inside the pocket or catching area of the glove 400. In some embodiments, the lacing 410 may form generally parallel lines 420 along the back surfaces 284, or it may cross over itself like it does at the back surfaces 284 shown in FIG. 3, or it may have other patterns. In general, the lacing 410 is positioned behind the front of the glove, weaving in and out of the back surfaces 284 and between the finger stalls 270, rather than passing through the front surfaces 283, for some or all of the finger stalls 270.

Figure 5:
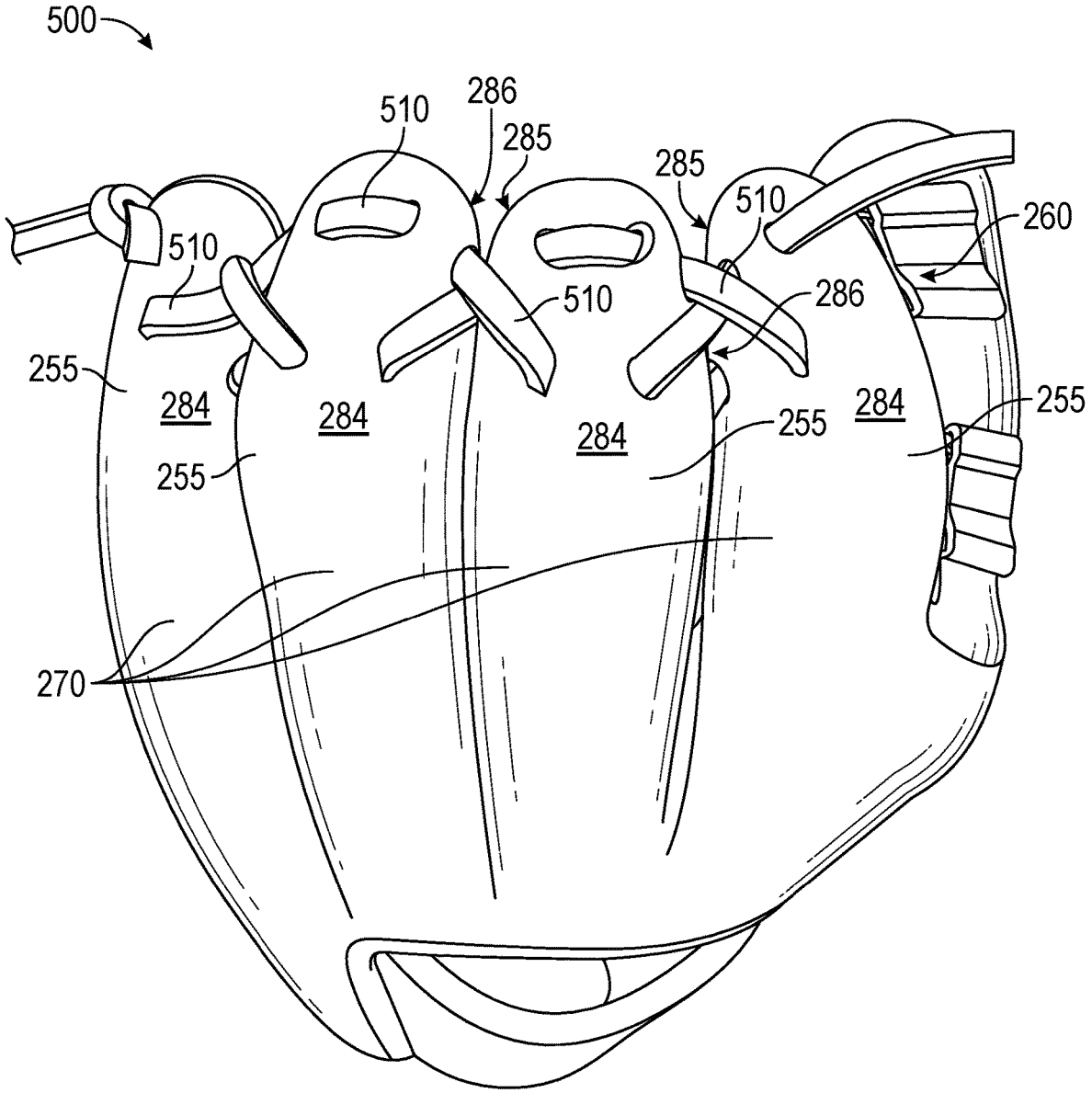
FIG. 5 illustrates a rear view of a ball glove configured in accordance with further embodiments of the present technology.

FIG. 5 illustrates a rear perspective view of a ball glove 500 configured in accordance with further embodiments of the present technology. Like the gloves 200, 400 described above with regard to FIGS. 2-4, the glove shown in FIG. 5 may not have lacing that passes along the front surface of one or more (such as all) of the finger stalls 270. Accordingly, the front side of the glove 500 is not shown, and it may have the same general configuration shown in the front view of the glove 200 in FIG. 2. In some embodiments, the lacing 510 may weave or extend through a side portion 285 of a first finger stall 270, between the first finger stall 270 and an adjacent finger stall 270, and into the back finger section 255 of the adjacent finger stall 270. This pattern may be implemented among two, three, or four finger stalls 270. In general, the lacing 510 is positioned behind the front of the glove, weaving in and out of the back surfaces 284 and between the finger stalls 270, rather than passing through the front surfaces 283, for some or all of the finger stalls 270.

Figure 6:
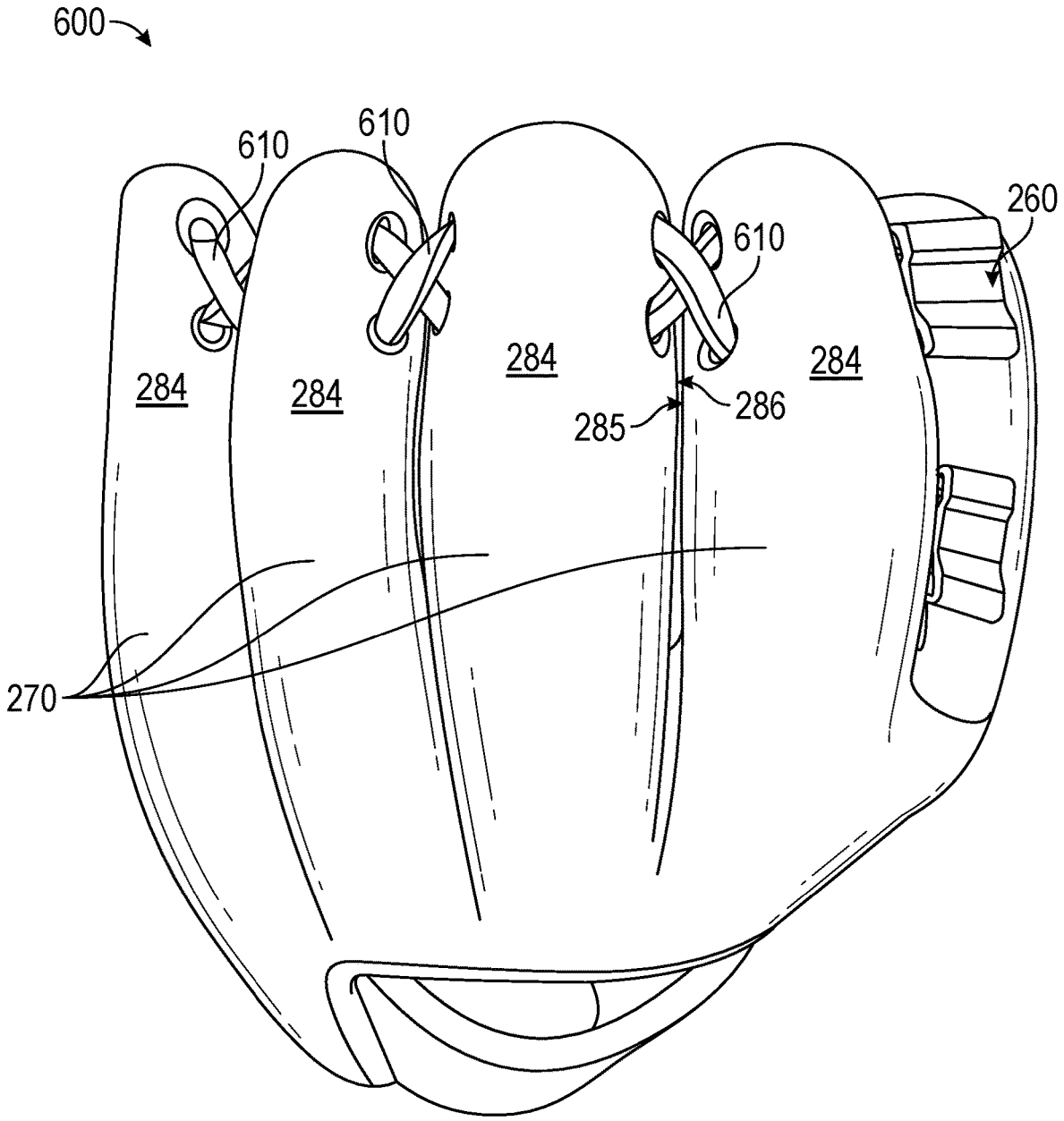
FIG. 6 illustrates a rear view of a ball glove configured in accordance with further embodiments of the present technology.

FIG. 6 illustrates a rear perspective view of a ball glove 600 configured in accordance with further embodiments of the present technology. Like the gloves 200, 400, 500 described above with regard to FIGS. 2-5, the glove shown in FIG. 6 may not have lacing that passes along the front surface of one or more (such as all) of the finger stalls 270, or in the palm region. Accordingly, the front side of the glove 600 is not shown, and it may have the same general configuration shown in the front view of the glove 200 in FIG. 2. In some embodiments, lacing 610 may only be between the opposing side portions 285, 286 of adjacent finger stalls 270, and it may optionally cross over itself to form an x pattern, or it may not cross over itself (e.g., similar to the lacing between the finger stalls 270 in FIG. 3). The lacing 610 may be positioned between the front surfaces 283 (see FIG. 2) and the back surfaces 284.

Ball gloves configured in accordance with embodiments of the present technology may be made from any suitable materials, including real leather, artificial leather, polymer materials, or other materials suitable for use in a ball glove. Some embodiments of the present technology can include other gloves, such as other sports gloves that may or may not have a web.

Ball gloves configured in accordance with embodiments of the present technology provide several advantages. For example, because there is reduced lacing or no lacing in the catching area, there may be fewer obstructions in the glove, so a player may be able to retrieve a ball from the glove faster than with a conventional glove. Further, a player may experience more comfort because there are fewer obstructions for their hand to hit while retrieving the ball from the glove.

From the foregoing, it will be appreciated that specific embodiments of the disclosed technology have been described for purposes of illustration, but that various modifications may be made without deviating from the technology, and elements of certain embodiments may be interchanged with those of other embodiments, and that some embodiments may omit some elements. For example, the lacing may take any suitable pattern as long as it is positioned between the finger stalls or on the back of the finger stalls, outside of the catching area. Although the finger stalls are described as lacking stitching on the front faces, in some embodiments, the thumb stall may also omit stitching on the front face, and it may be connected to the pointer-finger stall in a manner similar to the connections between the other finger stalls.

Further, while advantages associated with certain embodiments of the disclosed technology have been described in the context of those embodiments, other embodiments may also exhibit such advantages, and not all embodiments need to exhibit such advantages to fall within the scope of the technology. Accordingly, the disclosure and associated technology may encompass other embodiments not expressly shown or described herein.

What is claimed is:

1. A ball glove comprising:

a front portion including a palm section, a first thumb section, and a plurality of front finger sections;

a back portion including a second thumb section and a plurality of back finger sections; and a web portion connecting the thumb sections to a first front finger section of the plurality of front finger sections or a first back finger section of the plurality of back finger sections; wherein:

the front portion is connected to the back portion, with an opening between the front portion and the back portion for receiving a user's hand;

the first thumb portion is connected to the second thumb section to form a thumb stall for receiving a user's thumb;

each front finger section of the plurality of front finger section is connected to a back finger section of the plurality of back finger sections to form a plurality of finger stalls for receiving a user's fingers;

each finger stall of the plurality of finger stalls is connected to an adjacent finger stall of the plurality of finger stalls via lacing;

for at least three finger stalls of the plurality of finger stalls, the lacing does not pass through a front surface of the front finger section of each of the at least three finger stalls;

each finger stall of the at least three finger stalls has two opposing side portions positioned between the front finger section and the back finger section and connecting the front finger section to the back finger section; and for each finger stall of the at least three finger stalls, the lacing passes through the two opposing side portions.

2. The ball glove of claim 1, wherein the lacing passing through the two opposing side portions crosses over itself between two of the at least three finger stalls.

3. The ball glove of claim 1, wherein the lacing passing through the two opposing side portions forms two or more lacing lines between two of the at least three finger stalls that do not intersect with each other.

4. The ball glove of claim 1, wherein, for lacing passing through at least one of the two opposing side portions of a first finger stall of the at least three finger stalls, the lacing extends between the first finger stall and an adjacent finger stall of the at least three finger stalls, and wherein the lacing passes into the back finger section of the adjacent finger stall.

5. The ball glove of claim 1, wherein, for each finger stall of the at least three finger stalls, the lacing passes through the back finger section at least once.

6. The ball glove of claim 5, wherein, for each finger stall of the at least three finger stalls, the lacing passes through the back finger section at least twice.

7. The ball glove of claim 6, wherein, for each finger stall of the at least three finger stalls, the lacing crosses over itself at a rear surface of the back finger section.

8. The ball glove of claim 1, wherein, for each of the at least three finger stalls of the plurality of finger stalls, the lacing extends into the back finger section.

9. The ball glove of claim 1, wherein the at least three finger stalls of the plurality of finger stalls comprises four finger stalls.

10. The ball glove of claim 1, wherein lacing does not pass through a front surface of the palm section.

11. A ball glove comprising:

a front portion including a palm section, a first thumb section, and a plurality of front finger sections;

a back portion including a second thumb section and a plurality of back finger sections; and a web portion connecting the thumb sections to a first front finger section of the plurality of front finger sections or a first back finger section of the plurality of back finger sections; wherein:

the front portion is connected to the back portion, with an opening between the front portion and the back portion for receiving a user's hand;

the first thumb portion is connected to the second thumb section to form a thumb stall for receiving a user's thumb;

each front finger section of the plurality of front finger section is connected to a back finger section of the plurality of back finger sections to form a plurality of finger stalls for receiving a user's fingers, wherein each finger stall of at least three finger stalls of the plurality of finger stalls comprises a front surface on the front finger section, a back surface on the back finger section, a first side surface adjacent to the front surface and the back surface, and a second side surface adjacent to the front surface and the back surface opposite from the first side surface;

each finger stall of the plurality of finger stalls is connected to an adjacent finger stall of the plurality of finger stalls via lacing; and for each of the at least three finger stalls, the lacing passes through the first side surface or the second side surface.

12. The ball glove of claim 11, wherein the lacing crosses over itself at a location between two of the at least three finger stalls, wherein the location is also between the plurality of front finger sections and the plurality of back finger sections.

13. The ball glove of claim 11, wherein, for each finger stall of at least two finger stalls of the plurality of finger stalls, the lacing passes through the back finger section at least once.

14. The ball glove of claim 11, wherein, for each finger stall of at the least three finger stalls of the plurality of finger stalls, the lacing crosses over itself at a rear surface of the back finger section.

15. The ball glove of claim 11, wherein, for a first finger stall of the at least three finger stalls of the plurality of finger stalls, lacing extends from the first side surface or the second side surface into the back finger section of an adjacent finger stall of the at least three finger stalls.

16. A ball glove comprising:

a palm section forming at least part of a front surface of the ball glove;

a plurality of finger stalls, wherein each finger stall has a first surface forming at least part of the front surface, a second surface opposite the first surface and forming at least part of a back surface of the ball glove, and a side surface adjacent to the first surface and the second surface and positioned between the finger stall and an adjacent finger stall of the plurality of finger stalls;

a thumb stall;

a web portion connecting the thumb stall to a first finger stall of the plurality of finger stalls;

an opening for receiving a user's hand, wherein the opening is positioned at a proximal end of the glove; and connecting lacing positioned toward a distal end of the glove away from the proximal end of the glove, wherein the connecting lacing passes through two or more of the finger stalls;

wherein:

for each of the two or more of the finger stalls, the connecting lacing passes through the back surface and the side surface.

17. The ball glove of claim 16, wherein the two or more finger stalls comprises three or more finger stalls, and the connecting lacing passes into the side surface of a first finger stall of the three or more finger stalls and then into the back surface of an adjacent finger stall of the three or more finger stalls.

18. The ball glove of claim 16, wherein the two or more of the finger stalls comprises four of the finger stalls.

19. The ball glove of claim 16, wherein, for each of the two or more of the finger stalls, the connecting lacing crosses over itself on the back surface.

20. The ball glove of claim 16, wherein, for each of the two or more of the finger stalls, the connecting lacing does not pass through the front surface.

21. A ball glove comprising:

a front portion including a palm section, a first thumb section, and a plurality of front finger sections;

a back portion including a second thumb section and a plurality of back finger sections; and a web portion connecting the thumb sections to a first front finger section of the plurality of front finger sections or a first back finger section of the plurality of back finger sections; wherein:

the front portion is connected to the back portion, with an opening between the front portion and the back portion for receiving a user's hand;

the first thumb portion is connected to the second thumb section to form a thumb stall for receiving a user's thumb;

each front finger section of the plurality of front finger section is connected to a back finger section of the plurality of back finger sections to form a plurality of finger stalls for receiving a user's fingers;

each finger stall of the plurality of finger stalls is connected to an adjacent finger stall of the plurality of finger stalls via lacing;

for at least three finger stalls of the plurality of finger stalls, the lacing does not pass through a front surface of the front finger section of each of the at least three finger stalls; and for each finger stall of the at least three finger stalls of the plurality of finger stalls, the lacing extends into the back finger section.

22. A ball glove comprising:

a front portion including a palm section, a first thumb section, and a plurality of front finger sections;

a back portion including a second thumb section and a plurality of back finger sections; and a web portion connecting the thumb sections to a first front finger section of the plurality of front finger sections or a first back finger section of the plurality of back finger sections; wherein:

the front portion is connected to the back portion, with an opening between the front portion and the back portion for receiving a user's hand;

the first thumb portion is connected to the second thumb section to form a thumb stall for receiving a user's thumb;

each front finger section of the plurality of front finger section is connected to a back finger section of the plurality of back finger sections to form a plurality of finger stalls for receiving a user's fingers;

each finger stall of the plurality of finger stalls is connected to an adjacent finger stall of the plurality of finger stalls via lacing; and for four finger stalls of the plurality of finger stalls, the lacing does not pass through a front surface of the front finger section of each of the four finger stalls.

23. A ball glove comprising:

a front portion including a palm section, a first thumb section, and a plurality of front finger sections;

a back portion including a second thumb section and a plurality of back finger sections; and a web portion connecting the thumb sections to a first front finger section of the plurality of front finger sections or a first back finger section of the plurality of back finger sections; wherein:

the front portion is connected to the back portion, with an opening between the front portion and the back portion for receiving a user's hand;

the first thumb portion is connected to the second thumb section to form a thumb stall for receiving a user's thumb;

each front finger section of the plurality of front finger section is connected to a back finger section of the plurality of back finger sections to form a plurality of finger stalls for receiving a user's fingers;

each finger stall of the plurality of finger stalls is connected to an adjacent finger stall of the plurality of finger stalls via lacing;

for at least three finger stalls of the plurality of finger stalls, the lacing does not pass through a front surface of the front finger section of each of the at least three finger stalls; and lacing does not pass through a front surface of the palm section.

* * * * *